US006494699B2

(12) United States Patent
Sjoholm et al.

(10) Patent No.: US 6,494,699 B2
(45) Date of Patent: Dec. 17, 2002

(54) AXIAL UNLOADING LIFT VALVE FOR A COMPRESSOR AND METHOD OF MAKING THE SAME

(75) Inventors: Lars Ivan Sjoholm, Burnsville, MN (US); Gregory Gordon Anderson, Bloomington, MN (US)

(73) Assignee: Thermo King Corporation, Minneapolis, MN (US)

( * ) Notice: Subject to any disclaimer, the term of this patent is extended or adjusted under 35 U.S.C. 154(b) by 0 days.

(21) Appl. No.: 09/930,549

(22) Filed: Aug. 15, 2001

(65) Prior Publication Data

US 2002/0037230 A1 Mar. 28, 2002

Related U.S. Application Data

(60) Provisional application No. 60/225,352, filed on Aug. 15, 2000.

(51) Int. Cl.[7] ..... F04C 18/16; F04C 29/10

(52) U.S. Cl. ..... 418/201.2; 418/1; 29/888.023

(58) Field of Search ..... 418/1, 201.2; 29/888.023; 137/315.33

(56) References Cited

U.S. PATENT DOCUMENTS

| | | | | | |
|---|---|---|---|---|---|
| 3,151,806 | A | | 10/1964 | Whitfield | 418/201.2 |
| 4,453,900 | A | * | 6/1984 | Schibbye et al. | 418/201.2 |
| 4,478,054 | A | | 10/1984 | Shaw et al. | 418/98 |
| 4,662,190 | A | | 5/1987 | Tischer | 62/470 |
| 4,913,565 | A | | 4/1990 | Englund | 384/617 |
| 5,246,357 | A | | 9/1993 | Sjoholm et al. | 418/201.1 |
| 5,509,273 | A | | 4/1996 | Lakowske et al. | 418/201.2 |
| 5,556,271 | A | * | 9/1996 | Zuercher et al. | 418/201.2 |
| 5,722,163 | A | | 3/1998 | Grant et al. | 384/626 |
| 5,975,867 | A | | 11/1999 | Grant et al. | 418/201.1 |
| 5,979,168 | A | | 11/1999 | Beekman | 418/201.2 |

FOREIGN PATENT DOCUMENTS

| | | | | |
|---|---|---|---|---|
| EP | 0175354 | * | 3/1986 | 418/201.2 |
| GB | 1171191 | | 11/1969 | |

OTHER PUBLICATIONS

Lars Sjoholm, Variable Volume–Ratio and Capacity Control in Twin–Screw Compressors, Proceedings of the 1986 Intl. Compressor Engineering Conference—At Purdue, vol. II, Aug. 4–7, 1986, West Lafayette, Indiana, pp. 494–508.

* cited by examiner

*Primary Examiner*—John J. Vrablik
(74) *Attorney, Agent, or Firm*—Michael Best & Friedrich LLP

(57) ABSTRACT

A screw compressor having an unloader valve with a movable valve member, the unloader valve being capable of indicating when the valve member is installed incorrectly. The valve member is manufactured such that if it is installed incorrectly it provides a leakage path sufficiently large to be detected during full load testing of the compressor. When the screw compressor fails the load test, the compressor is partially disassembled, and the valve is reinstalled in the proper orientation and the compressor is re-tested. The valve member leakage path is provided while maintaining low costs for production and assembly of the compressor.

20 Claims, 5 Drawing Sheets

AXIAL UNLOADING LIFT VALVE FOR A COMPRESSOR AND METHOD OF MAKING THE SAME

RELATED APPLICATIONS

This application claims priority to provisional application serial No. 60/225,352, filed on Aug. 15, 2000.

FIELD OF THE INVENTION

The invention relates to screw compressors, and more particularly to axial unloading lift valves for screw compressors.

BACKGROUND OF THE INVENTION

Axial unloading lift valves are commonly used in screw compressors to vary the compression load produced by the screws. One or more valves are arranged axially towards the discharge side of the screws and the load is varied by selectively opening and closing the valves. Opening the valves to "unload" the compressor reduces the effective working length of the screws by opening communication pathways between portions of the screw and the low-pressure suction end of the compressor. The open pathways allow the pressure to equalize so that compression does not occur over the portions of the screw communicating with the suction end of the compressor. When the valves are closed to "load" the compressor, no pressure equalization occurs over the axial length of the screw. Therefore, the full working length of the screws is utilized for compression. The angular location of the valves around the discharge ends of the screws determines how much of the axial working length of the screws is used or eliminated when the valves are closed or opened.

FIGS. 1 and 2 are schematic representations showing a portion of a prior art compressor 10 having an axial unloading lift valve 14. FIG. 1 shows the valve 14 in the loaded condition and FIG. 2 shows the valve 14 in the unloaded condition. The compressor 10 includes a pair of screws 15, 16 (only one is shown in FIGS. 1 and 2) mounted for rotation in a screw housing 22. The interior of the screw housing 22 defines a compression chamber 24 where the fluid is compressed by the screws 15, 16, as is understood by those skilled in the art. A discharge housing 26 supports the discharge end of the screws 15, 16 and is coupled to one end of the screw housing 22. A suction housing 30 supports the suction end of the screws 15, 16 and is coupled to the other end of the screw housing 22.

The axial unloading valve 14 typically includes a cylindrically-shaped valve member 34 housed in a valve chamber 38. The valve chamber 38 is formed in the discharge housing 26 so that one end of the valve chamber 38 communicates both with the compression chamber 24 and with a vent passageway 42. The vent passageway 42 is connected to a suction cavity 46 formed in the suction housing 30. The other end of the valve chamber 38 communicates with a high-pressure fluid supply that controls the positioning of the valve member 34. The high-pressure fluid supply is typically either high-pressure lubricating oil or refrigerant that has been discharged from the compressor.

To load the compressor 10, the valve 14 is closed by flooding the valve chamber 38 with high-pressure fluid. The fluid in the valve chamber 38 forces the valve member 34 toward the screw housing 22 until the valve member 34 abuts the screw housing 22, as shown in FIG. 1. When the valve member 34 is in the position shown in FIG. 1, there is no communication, and therefore no pressure equalization, between the suction cavity 46 and the compression chamber 24. Because there is no pressure equalization, the entire working length of the screws 15, 16 is utilized and maximum compression loading is generated by the compressor 10.

To unload the compressor 10, the valve 14 is opened by draining the fluid from the valve chamber 38. The high-pressure fluid in the compression chamber 24 forces the valve member 34 away from the screw housing 22, as shown in FIG. 2. When the valve member 34 is in the position shown in FIG. 2, the passageway 42 provides communication, and therefore pressure equalization, between the compression chamber 24 and the suction cavity 46. This pressure equalization reduces the effective working length of the screws 15, 16, thereby reducing the compression load generated by the compressor 10.

SUMMARY OF THE INVENTION

For the axial unloading valve 14 to function properly, the valve member 34 must be carefully manufactured and installed. FIG. 3 shows a prior art valve member 34 in greater detail. The valve member 34 is substantially cylindrical and includes opposing first and second axial sealing surfaces 50 and 54, respectively. A radial sealing and positioning surface 58 extends between the axial sealing surfaces 50 and 54.

With this symmetrical configuration, the valve member 34 could be installed in the valve chamber 38 in two ways. Therefore, both the first and the second axial sealing surfaces 50 and 54 must be machined to tight axial run-out tolerances to ensure that, regardless of how the valve member 34 is installed, proper axial sealing occurs when the valve 14 is closed. The term "run-out" is well-known to those in manufacturing and in this situation is generally understood to refer to the perpendicularity between a longitudinal axis 62 and each of the axial sealing surfaces 50 and 54. In addition to sealing concerns, the tight run-out tolerance ensures that no portion of the valve member 34 will interfere with the 5 screws 15, 16 when the compressor 10 is operating at full load (i.e., when the valve 14 is closed). This is especially important on compressors having small axial screw endplay with respect to the discharge housing 26. Maintaining the tight axial run-out tolerances requires expensive precision machining and, because both axial sealing surfaces 50 and 54 must be tightly toleranced, two separate machine setups are required for two separate precision machining operations. This significantly increases the manufacturing cost of the valve member 34.

One way to eliminate the need for two tightly-toleranced axial sealing surfaces 50, 54 on the valve member 34 is to change the design. FIG. 4 illustrates an alternative prior art valve member 66 that has only one axial sealing surface 70. Additionally, the radial sealing surface 74 and the radial positioning surface 78 are separate surfaces. This ensures that the valve member 66 can only be installed in one way, thereby eliminating the need for a second axial sealing surface with a tight run-out tolerance.

While only one precision machining setup is necessary for achieving the desired run-out tolerance on the single axial sealing surface 70, a separate machining operation is still required to form the radial positioning surface 78. This second operation need not be precision machining, but nonetheless requires a second machine setup. The two separate machine setups required to manufacture the different radial surfaces 74 and 78 can create tolerance stack-up problems and often mandate the use of a gasket 82 to prevent leakage. The use of the gasket 82 also adds to the cost of the compressor 10 and increases the number of parts that may require periodic replacement.

The present invention provides an improved valve member for an axial unloading lift valve. The improved valve member has only one axial sealing surface requiring a tight run-out tolerance. Therefore, only one machine setup is needed to produce the sealing surfaces of the improved valve member. Additionally, the valve member of the present invention includes features that facilitate proper assembly and ensure that the valve member is properly installed. No gaskets are required to seal the valve member. Thus, the valve member of the present invention provides a less-expensive and more reliable valve member than the prior-art valve members described above.

More specifically, the invention provides a screw compressor having a housing, a drive screw supported by the housing, and an idler screw supported by the housing. The drive screw and idler screw assembly have a low-pressure end and a high-pressure end. The drive screw, driven by an outside force, drives the idler screw, to which the drive screw is operably engaged. Rotation of the screws moves a fluid from the low-pressure end to the high-pressure end. The screw compressor further has at least one vent passageway with one end in fluid communication with the low-pressure region and a second end in selective fluid communication with the high-pressure end. In addition, the screw compressor has at least one valve having a valve member. Each valve member has a sealing surface, a non-sealing surface, and a radial sealing surface partially extending between the sealing surface and the non-sealing surface, the non-sealing surface having a recess. The valve is positioned such that the valve member is installable in a correct orientation and an incorrect orientation. When installed in the correct orientation the valve member is movable between a loaded position, at which the valve member substantially prevents flow from the high-pressure end to the low-pressure end, and an unloaded position, at which fluid passes from the high-pressure region through the vent passageway to the low-pressure region. When the valve member is installed in the incorrect orientation, the valve member provides a flow path from the high-pressure end through the vent passageway to the low-pressure end when in the loaded position and the unloaded position.

Other features and advantages of the invention will become apparent to those skilled in the art upon review of the following detailed description, claims, and drawings.

Figure 1:
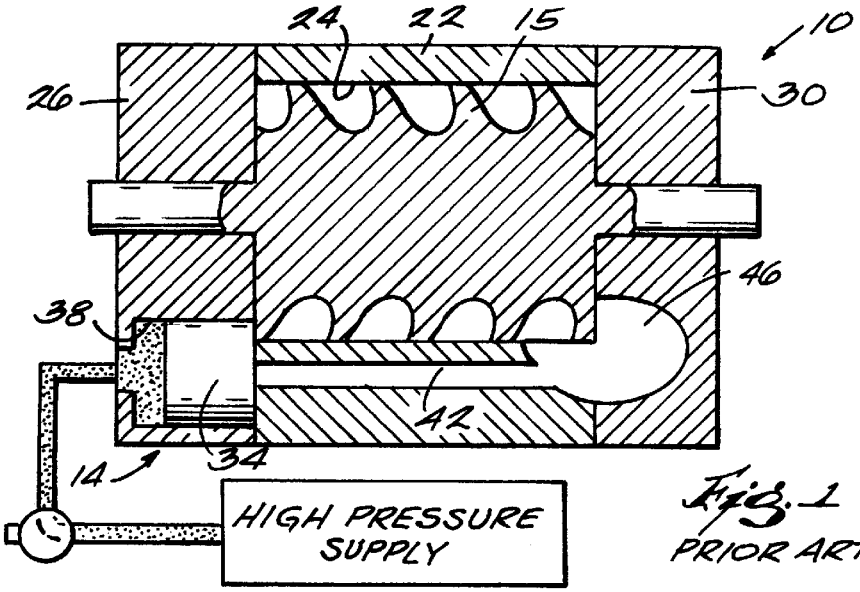
Fig. 1 PRIOR ART
FIG. 1 is a schematic illustration of a prior art screw compressor with an axial unloading lift valve shown in the full load position.
Figure 2:
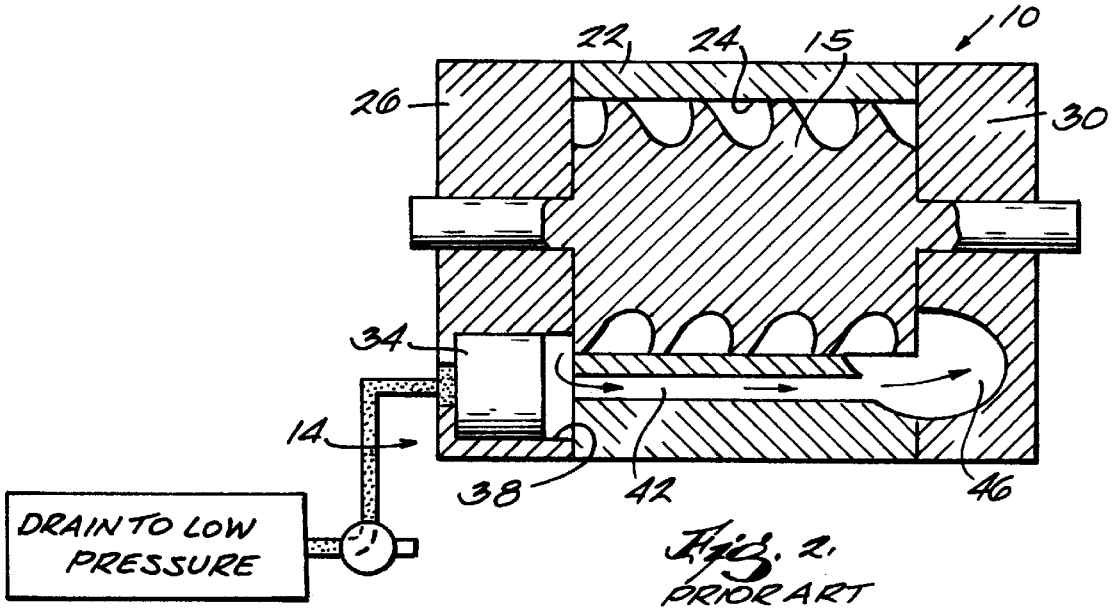
Fig. 2. PRIOR ART
FIG. 2 is a schematic illustration of the prior art screw compressor of FIG. 1 with the axial unloading lift valve shown in the partial load position.
Figure 3:
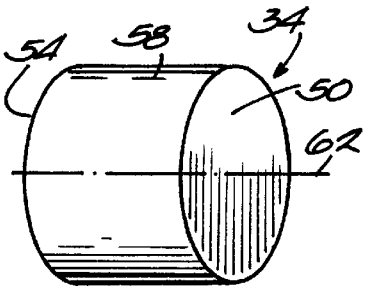
Fig. 3 PRIOR ART
FIG. 3 is a perspective view of a prior art axial unloading lift valve.
Figure 4:
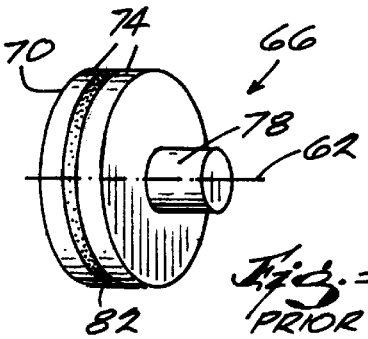
Fig. 4 PRIOR ART
FIG. 4 is a perspective view of another prior art axial unloading lift valve.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items.

DETAILED DESCRIPTION OF THE PREFERRED EMBODIMENT

Figure 8:
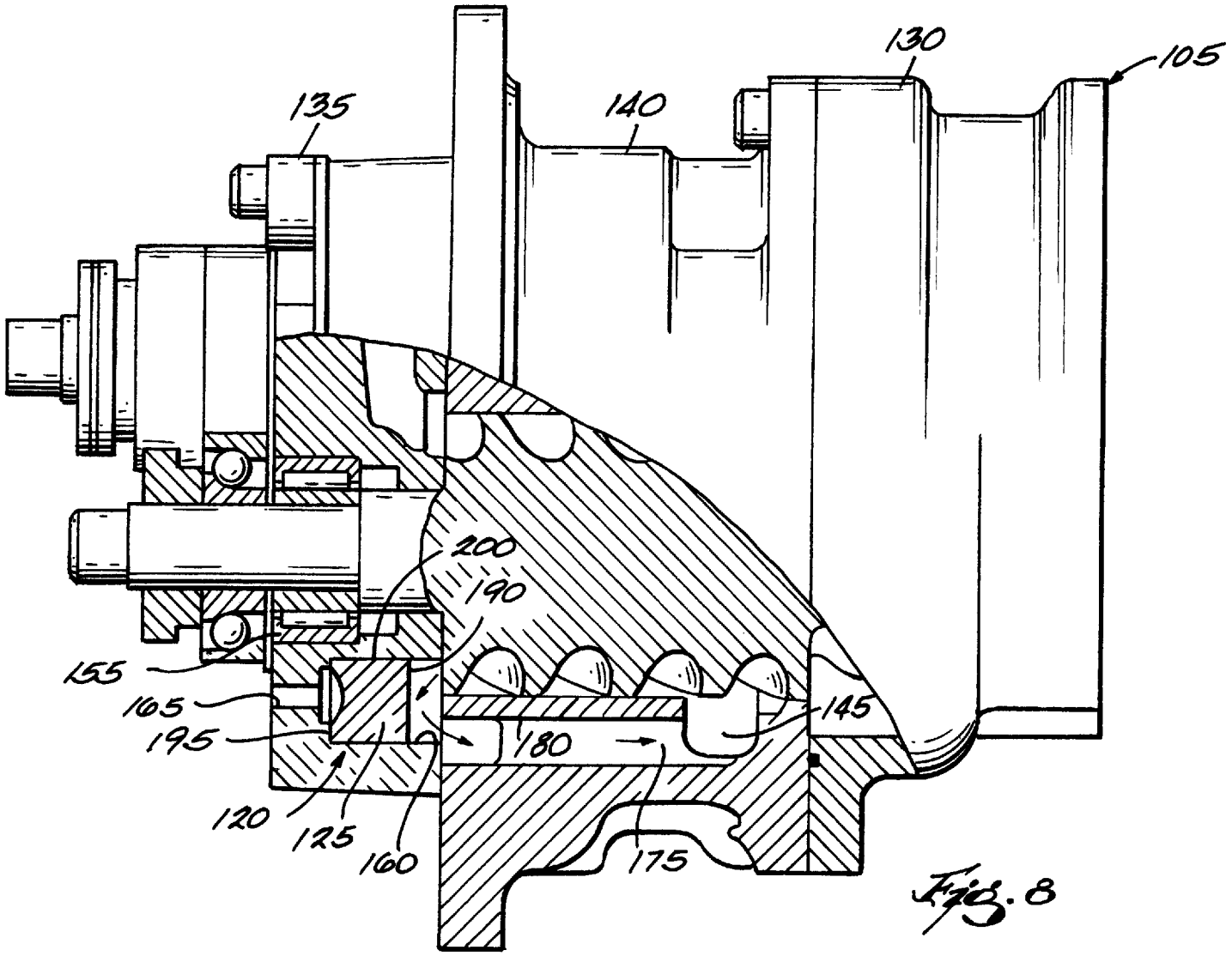
FIG. 8 is a section view of a screw compressor having the axial unloading valve shown in FIG. 5 installed correctly in the unloaded position.
Figure 9:
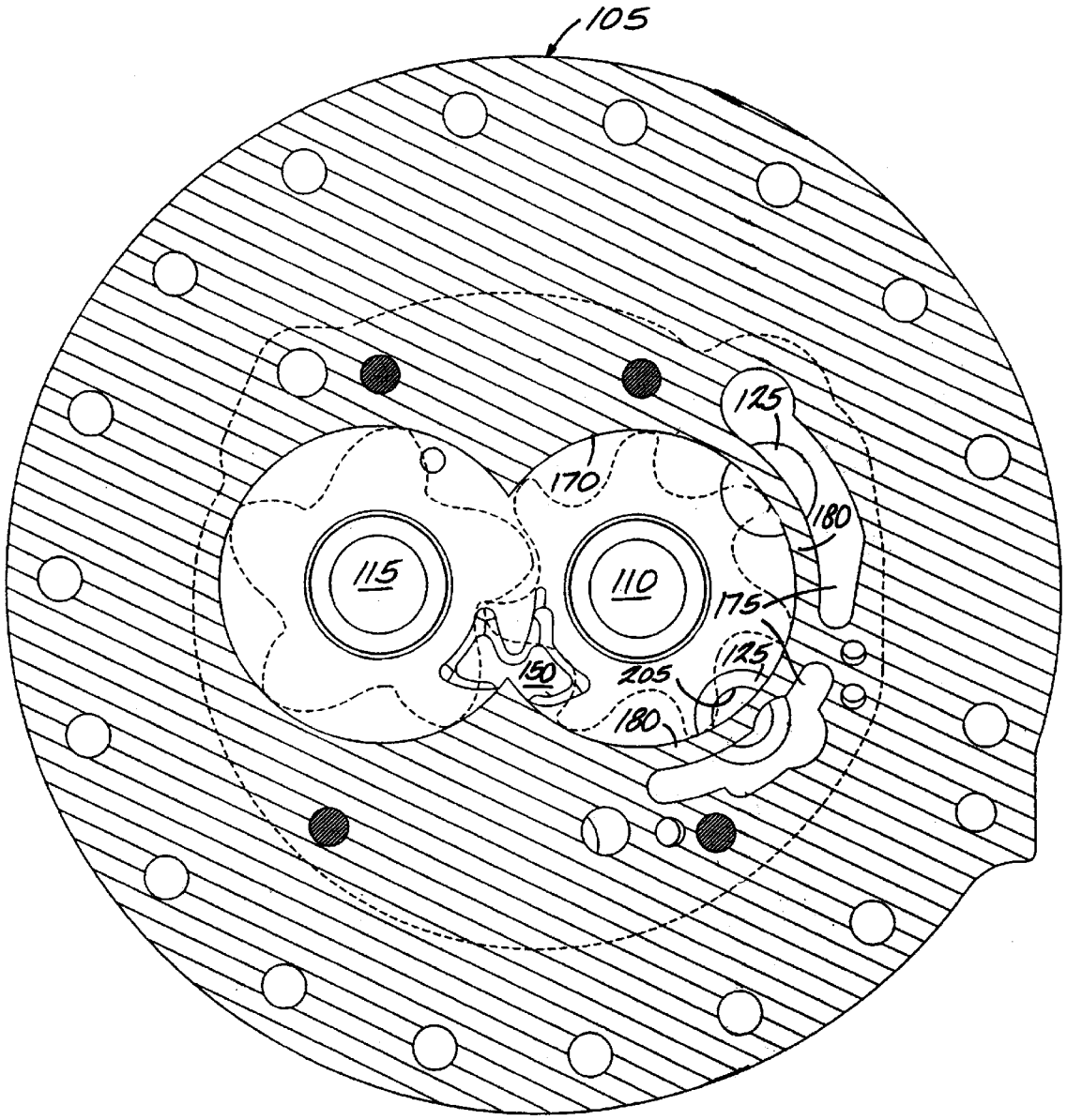
FIG. 9 is a section view of a screw compressor showing both screws and two valves.

Screw type compressors 100 of the type described herein are commonly used to move fluids (liquid or gas) such as oil, water, refrigerant, or other like substances. Screw type compressors 100, as shown in FIGS. 6–9, use a housing 105 and a pair of screws to increase the pressure of a fluid and move the fluid through the compressor 100. The two screws are called the drive screw 10 and the idler screw 115. In addition to these components, most systems in which a screw type compressor 100 is used contain an unloading valve 120. The unloading valve 120 can be separate from the compressor 100, however more typically the unloading valve 120 is incorporated into the compressor housing 105, as in the present invention. In addition, multiple unloading valves 120 can be employed in the same compressor 100 to provide redundant functions or to perform different functions. For example, FIG. 9 shows a compressor 100 with two unloading valves 120. One of the unloading valves 120 has a valve member 125 installed properly while the other unloading valve 120 is shown with the valve member 125 installed improperly. It should be noted that the unloading valves 120, in the figures provided, are arranged around the drive screw 110 only. It is however, possible to arrange unloading valves 120 around either, or both screws 110, 115.

Figures 5, 6:
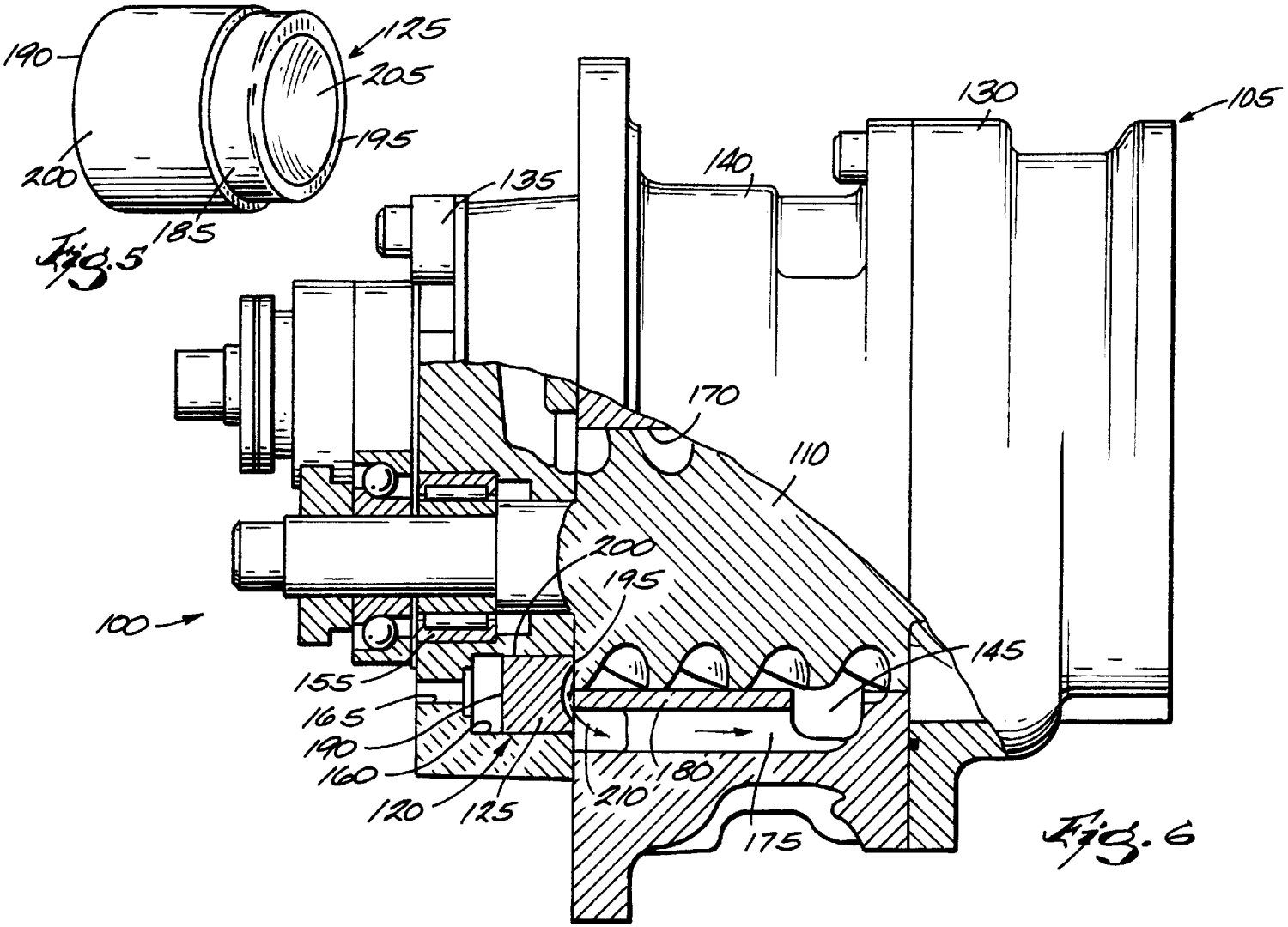
FIG. 5 is a perspective view of an axial unloading lift valve embodying the present invention.
FIG. 6 is a partial section view of a screw compressor having the axial unloading lift valve shown in FIG. 5 installed incorrectly.

In general, the compressor housing 105 is formed from three separate pieces, a suction end 130, a discharge end 135, and a screw housing 140. The three pieces are then assembled to form a complete housing 105. While it is possible to manufacture a housing 105 from less than three pieces, assembly of the other compressor components into the housing 105 becomes more complex as the number of housing pieces are reduced. For example, a housing 105 in which one of the end pieces 130 or 135 is combined with the screw housing 140 would require a very intricate casting or significant machining to complete. The three-piece arrangement, requires the same intricacy, however, with three pieces, access to the different regions requiring machining is simplified. Typically, the three pieces are cast into a rough shape, and then surfaces requiring a tighter tolerance or better surface finish are machined. The pieces are generally cast aluminum, steel, iron, bronze, or other material capable of containing fluid at the required operating pressures and temperatures. The end pieces 130, 135 each contain a chamber for the collection of a fluid. The suction end chamber or cavity 145 contains low-pressure fluid and defines a low-pressure region. The discharge end chamber 150 (see FIG. 9) contains high-pressure fluid and defines a high-pressure region. Generally, the regions are cast into the end pieces 130, 135 and require no additional machining. Each end piece 130, 135 further contains two bored regions, each sized to receive a bearing 155 which in turn supports either the drive screw 110 or the idler screw 115. Any bearing type can be used to support the screws 110, 115 within the end pieces 130, 135 including roller bearings, ball bearings, needle bearings, and journal bearings. The illustration of FIG. 6 shows only one of the two screws 110, 115, the one screw using needle bearings 155 for support within the housing 105. The bearings 155 are of a known design; capable of operating effectively under the conditions experienced by the compressor. Each end piece 130, 135 attaches to the screw housing 140 using a known attachment, typically a series of bolts or screws. To improve the seal between the end pieces 130, 135 and the screw housing 140, gaskets can be used. The gasket material should provide a superior seal throughout the operating temperature and pressure ranges of the compressor.

The discharge end piece 135 contains one or more bores or valve chambers 160, sized to receive the unloading valve member 125. A smaller bore 165 opens the valve chamber 160 to the outside surface of the end piece 135 allowing for the connection of a control fluid supply. The control fluid can be hydraulic oil, or any fluid compressed by the compressor, such as refrigerant. The use and function of the control fluid is well known in the art and will not be described in detail.

The screw housing 140 is manufactured in a manner very similar to that used to make the end pieces 130, 135. In addition, similar materials are used. Two large bores placed in the screw housing 140 form a compression chamber 170, which accommodates the screws 110, 115. The bores are spaced apart a distance which allows the two screws 110, 115 to mesh while still providing enough clearance to allow free rotation of the screws 110, 115. The size of each bore is precisely controlled to achieve a minimum operating clearance between the bore and the screws 110, 115 that rotate within the bore. Any excess clearance between the walls of the compression chamber 170 and the screws 110, 115 will reduce the compressor's efficiency, volumetric output, and maximum pressure output. A vent passageway 175, parallel to the compression chamber 170, provides a flow path from the high-pressure end of the screws 110, 115 to the low-pressure region, when the unloading valve 120 is in the unloaded position or is installed improperly. The vent passageway 175 can be any shape so long as it provides an adequate flow area, alone or in combination with other unloading valves 120, to unload the compressor 100. In addition, a wall 180, typically formed as part of the housing 105, exists between the vent passageway 175 and the compression chamber 170. The function of the wall 180 will be described in detail in forthcoming paragraphs. While only one vent passageway 175 has been described, it is possible to have several vent passageways 175 spaced radially around the screws 110, 115. The only limitation to the number of unloading valves 120 and vent passageways 175 is the radial space surrounding the screws 110, 115.

A screw type compressor 100 uses two meshed screws 110, 115 to move and pressurize fluid. The screws 110, 115 are in fluid communication with two regions within the end pieces 130, 135. The suction region, or low-pressure region, contains a supply of low-pressure fluid, which is drawn into the screws 110, 115 during operation. The discharge region, or high-pressure region, located in the discharge end piece 135, collects the compressed fluid leaving the compressor 100.

A screw type compressor 100 compresses a fluid by trapping the fluid in a series of pockets and then reducing the volume of the pockets, thus increasing the pressure therein. Rotation of the screws 110, 115 forces the fluid toward the high-pressure end of the screws 110, 115 where it is discharged producing a continuous flow of high-pressure fluid. Typically, one screw, the drive screw 110, is coupled to an electric motor or other prime mover capable of turning the drive screw 110. Rotation of the drive screw 110 forces the idler screw 115, which is meshed with the drive screw 110, to turn. The two screws 110, 115 working together trap and force the fluid to move toward the high-pressure region. The screws 110, 115 are sized to fit within the housing 105 such that there is very little endplay in the screws 110, 115. This means that the gap between the high-pressure end of the screws 110, 115 and the housing 105 is small enough to prevent substantial leakage between adjacent pockets.

As the screws 110, 115 rotate, fluid is trapped in a pocket formed between the mesh point of the screws 110, 115 and the housing 105 at the high-pressure end of the screws 110, 115. Continued rotation allows the end of the pocket to eventually pass over the discharge opening 150 and discharge the high-pressure fluid. If an unloading valve 120 is open at some point before the discharge opening 150, the pressure within the pocket will prematurely discharge. For example, if an unloading valve 120 were open at a point one-half of a revolution before the discharge opening 150, the fluid would discharge at that point. However, fluid remains within the pocket at a pressure approximately equal to the pressure in the low-pressure region. After the pocket passes the open unloading valve 120, the high-pressure end will again seal and the pocket volume will continue to reduce. The continued rotation of the screws 110, 115, after passing the open unloading valve 120, will continue compressing the trapped fluid. Because the full rotation of the screws 110, 115 is not utilized in compressing the fluid, the outlet pressure will be less than the maximum achievable, and the effective length of the screws 110, 115 is reduced.

With this background in mind, the unloading valve 120 will now be discussed. Unloading valves 120 of the type described herein are capable of performing several known functions. For example, an unloading valve 120 can be used to maintain the pressure leaving the compressor 100 at a value below its maximum. The unloading valve 120 can be radially positioned such that the effective length of the screws 110, 115 is reduced a desired amount. The rotational angle between the unloading valve 120 and the discharge area 150 control the effective length of the screws 110, 115. Shortening the effective length of the screws 110, 115 reduces the compressor's output pressure. This and other uses for unloading valves 120 are well known in the art and will therefore not be described in further detail.

FIG. 5 illustrates an embodiment of an unloading valve member 125 of the present invention. It should be pointed out that the relief area 185 shown in FIG. 5 is greatly exaggerated in the figure and does not appear in the other figures. The unloading valve 120 of the present invention contains a movable cylindrical valve member 125 housed in a valve chamber 160. The valve chamber 160, and thus the valve member 125, is positioned such that the valve member 125, in the loaded position, is in sealable contact with the wall 180. The wall 180, positioned between the screw bore and the vent passageway 175, allows the valve member 125 to prevent flow therebetween. The valve member 125 has a sealing side 190 and a non-sealing side 195 along with a radial sealing surface 200. The sealing side 190 and the radial sealing surface 200 are manufactured to very tight tolerances to ensure that they provide adequate seals. For example, the maximum allowable run-out on the sealing side surface 190 is approximately 0.008 mm (0.0003 in), while the allowable run-out on the non-sealing surface 195 is approximately 0.02 mm (0.0008 in). Run-outs as high as about 0.010 mm (0.0004 in) for the sealing surfaces 190 and 200, and as low as about 0.015 mm (0.0006 in) for the non-sealing surface will function with the present invention.

The radial sealing surface 200 of the valve member 125 acts as a seal between the control fluid and the compression chamber 170. In addition, the radial sealing surface 200 prevents leakage around the valve member 125 to the vent passageway 175 when in the loaded position. Further, the radial sealing surface 200 acts as a guide during assembly and during movement of the valve member 125. To aid in the assembly process, the radial sealing surface 200 is relieved slightly as shown in FIG. 5. The relieved portion 185 is inserted into the valve chamber 160 before bolting the discharge end piece 135 to the screw housing 140. The relief area 185 allows the valve member 125 to slide into the valve chamber 160 more easily. In addition to simplifying assembly, the relieved portion 185 simplifies manufacturing by allowing for the creation of the relief or dimple 205 in the non-sealing axial surface 195 without upsetting the radial sealing surface 200. Whether the dimple 205 is machined, stamped, or formed using other known processes, the relief area 185 allows for small movements of the relieved radial surface 185 without affecting the tight tolerance areas. To ensure that the dimple 205 does not affect the radial sealing surface 200, the dimple 205 should extend no deeper than the relief area 185. In other words, the axial length of the relieved area 185, as measured from the non-sealing surface 195, should be equal to or greater than the depth of the dimple 205.

The sealing side 190 of the valve member 125 in the loaded position prevents flow between the high-pressure end of the screws 110, 115 and the vent passageway 175. The sealing side 190 is forced against the wall 180 between the screw bore and the vent passageway 175 to form a seal. The seal area is relatively narrow and the pressure drop from the high-pressure side to the low-pressure side is potentially large requiring a good seal surface, thus the tight run-out requirements.

The valve member 125 of the present invention is simple and inexpensive to produce and assemble correctly. The sealing surfaces 190, 200 of the present invention can be machined in one setup, greatly reducing the cost of the component. Further, the dimple 205 can be produced in any number of ways available to typical manufacturing facilities. The valve member 125 is therefore inexpensive to manufacture. Assembly remains easy and the detection of an incorrect assembly is greatly simplified by the present invention.

The valve member 125 of the present invention uses a cylindrical-shaped body having a sealing side surface 190 manufactured to the rigid run-out requirements previously described. The non-sealing side 195 is dimpled to produce a leakage path if it is installed improperly and positioned in the loaded position. FIG. 6 illustrates the present embodiment of the valve member 125 installed incorrectly, and positioned in the loaded condition. One can see that a flow path 210 between the end of the screws 110, 115 and the low-pressure region exists even when the valve member 125 is in the loaded position. During load testing of this compressor 100, before its shipment to a customer, this problem will be evident and can be easily corrected by reversing the orientation of the valve member 125. The compressor 100 of FIG. 6 will be incapable of producing a pressure output corresponding to its maximum design output.

Figure 7:
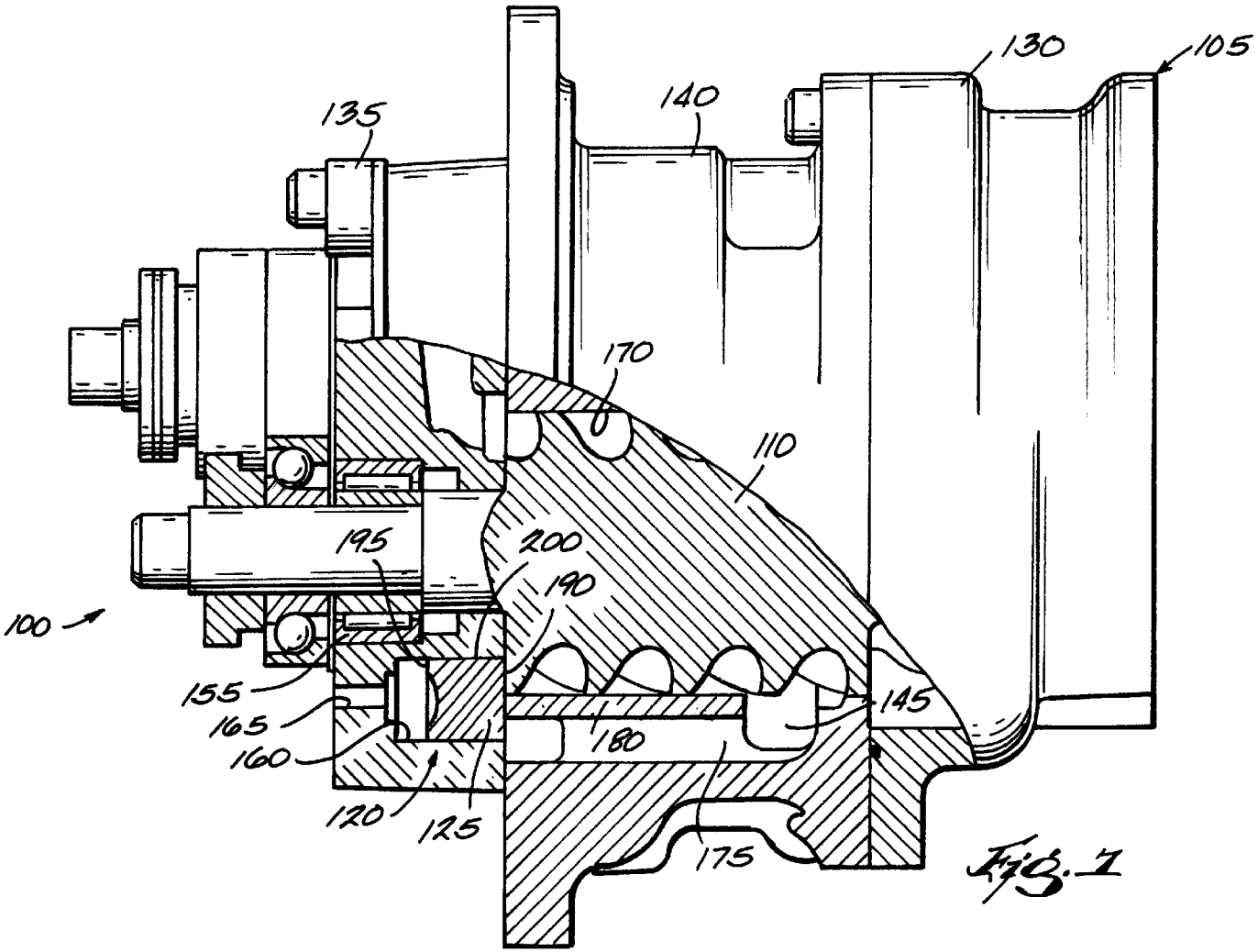
FIG. 7 is a section view of a screw compressor having the axial unloading valve shown in FIG. 5 installed correctly in the loaded position.

FIG. 7 shows the compressor 100 in the loaded position with the valve member 125 installed correctly. Clearly, no flow path exists between the high and low-pressure regions, and the compressor 100 output will correspond to the maximum design output. FIG. 8 shows the compressor 100 of the present invention in which the valve member 125 is installed correctly and the valve 120 is in the unloaded position.

While a non-sealing surface 195 having a dimple 205 has been described, many other shapes are possible. Any shape protrusion or recess 205 will function as long as it provides a leakage flow path 210. In addition, the shape used should provide a relatively symmetric support that contacts the wall 180 so that there is no tendency for the valve member 125 to twist, bind, or stick. For example, a large hole drilled into the center of the non-sealing surface 195 would provide a leak path around the wall 180 while still allowing adequate support. In addition, a plurality of slots cut across the non-sealing surface 195 at different angles relative to one another would provide leakage paths 210 as well as adequate contact support. It should be clear to a person skilled in the art that there are many ways to adapt the non-sealing surface 195 to assure leakage if the valve member 125 is installed incorrectly.

The resulting valve member 125 should, when installed properly, seal the high-pressure end of the screws 110, 115 from the low-pressure region when in the loaded position and provide a substantial leakage path 210 when installed incorrectly. The leak path 210 should produce leakage that is detectable during a load test of the compressor 100. Typically, the leakage will manifest itself as an inability to achieve the desired output pressure. When this condition is detected, it is a simple task to partially disassemble the compressor 100, invert the valve member 125, reassemble the compressor 100, and retest the compressor 100.

Although particular embodiments of the present invention have been shown and described, other alternative embodiments will be apparent to those skilled in the art and are within the intended scope of the present invention. Thus, the present invention is to be limited only by the following claims.

Various features of the invention are set forth in the following claims.

We claim:

1. A screw compressor comprising:

a housing having a wall;

a drive screw supported by the housing;

an idler screw supported by the housing, the idler screw engaged with the drive screw;

an unloading valve operable to selectively allow and prevent pressure equalization between an area of high pressure at a first location in the compressor and an area of low pressure at a second location in the compressor, the unloading valve having a valve member including;

a sealing surface configured to engage the wall of the housing such that substantially no leakage path exists around the wall when the valve member is properly oriented and is positioned to prevent pressure equalization; and a non-sealing surface spaced a distance from the sealing surface, the non-sealing surface having a recess that provides a leakage path around the wall and between the first location and the second location when the valve is improperly oriented and positioned to prevent pressure equalization.

2. The compressor of claim 1, wherein the non-sealing surface recess is a circular concave dimple located approximately concentric to the non-sealing surface.

3. The compressor of claim 1, wherein the valve member further includes a sealing and positioning surface that extends at least partially between the sealing surface and the non-sealing surface.

4. The compressor of claim 1, wherein the valve member is linearly movable to selectively allow and prevent pressure equalization between the first location and the second location.

5. The compressor of claim 1, further comprising at least one additional unloading valve.

6. The compressor of claim 1, wherein the sealing surface has a smaller run-out tolerance than the non-sealing surface.

7. The compressor of claim 6, wherein the run-out tolerance on the sealing surface is less than about 0.010 mm and the run-out tolerance on the non-sealing surface is more than about 0.015 mm.

8. The compressor of claim 1, wherein the valve member further comprises a radially relieved area extending a length from the non-sealing surface and a radial sealing surface extending from the sealing surface to the relieved area.

9. The compressor of claim 8, wherein the recess extends from the non-sealing surface a depth not greater than the length the radially relieved area extends from the non-sealing surface.

10. A screw compressor comprising:

a housing;

a drive screw supported by the housing;

an idler screw supported by the housing, the drive screw and idler screw having a low-pressure end and a high-pressure end, the idler screw operably engaged with the drive screw to move a fluid from the low-pressure end to the high-pressure end;

at least one vent passageway having a first end in fluid communication with the low-pressure end and a second end in selective fluid communication with the high-pressure end; and at least one valve having a valve member, the valve member having a sealing surface, a non-sealing surface and a radial sealing surface partially extending between the sealing surface and the non-sealing surface, the non-sealing surface having a recess therein;

wherein the valve member is installable in a correct orientation and an incorrect orientation, and when installed in the correct orientation the valve member is movable between a loaded position, at which the valve member substantially prevents flow from the high-pressure end to the low-pressure end, and an unloaded position, at which fluid passes from the high pressure region through the vent passageway to the low pressure region, and when the valve member is installed in the incorrect orientation the valve member provides a flow path from the high-pressure end through the vent passageway to the low-pressure end when in the loaded position and the unloaded position.

11. The compressor of claim 10, wherein the non-sealing surface recess is a circular concave dimple located approximately concentric to the non-sealing surface.

12. The compressor of claim 10, wherein the valve member is linearly movable between the loaded position and the unloaded position.

13. The compressor of claim 10, wherein the sealing surface has a smaller run-out tolerance than the non-sealing surface.

14. The compressor of claim 13, wherein the run-out tolerance on the sealing surface is less than about 0.010 mm and the run-out tolerance on the non-sealing surface is more than about 0.015 mm.

15. The compressor of claim 10, wherein the valve member further comprises a radially relieved area extending a length from the non-seal surface to the radial sealing surface.

16. The compressor of claim 15, wherein the recess extends from the non-sealing surface a depth not greater than the length the radially relieved area extends from the non-sealing surface.

17. A method of determining whether a valve member for an unloading valve is properly installed in a screw compressor, the valve member including a sealing surface that substantially closes a communication pathway when the valve member is installed in a first orientation and the unloading valve is in a first position, and a non-sealing surface that does not substantially close the communication pathway when the valve member is installed in a second orientation and the unloading valve is in the first position, the method comprising:

operating the compressor with the unloading valve in the first position;

monitoring the load produced by the compressor; and comparing the monitored load to a predetermined load value to determine whether the valve member is properly installed.

18. The method of claim 17, further including:

changing the orientation of the valve member based on the comparison between the monitored load and the predetermined load value.

19. The method of claim 18, wherein the orientation of the valve member is changed when the monitored load is substantially different from the predetermined load value.

20. The method of claim 19, wherein the predetermined load value corresponds to the load produced when the valve member is in the first orientation and the monitored load corresponds to the load produced when the valve member is in the second orientation.

* * * * *